United States Patent [19]

Eichenberger

[11] 4,276,910

[45] Jul. 7, 1981

[54] PHOTOELECTRICAL BOBBIN FEELER

[75] Inventor: Werner Eichenberger, Zürich, Switzerland

[73] Assignee: Gebrüder Loepfe AG, Wetzikon, Switzerland

[21] Appl. No.: 123,842

[22] Filed: Feb. 22, 1980

[30] Foreign Application Priority Data

Mar. 15, 1979 [CH] Switzerland ..... 2443/79

[51] Int. Cl.[3] ..... D03D 45/12

[52] U.S. Cl. ..... 139/273 A; 250/571; 250/577; 250/561

[58] Field of Search ..... 139/273 A, 370.2; 250/216, 571, 577; 356/432, 434, 435

[56] References Cited

U.S. PATENT DOCUMENTS

| | | | |
|---|---|---|---|
| 3,693,671 | 9/1972 | Desai | 139/273 A |
| 3,777,168 | 12/1973 | Sansone | 250/561 |
| 3,892,492 | 7/1975 | Eichenberger | 250/571 |

FOREIGN PATENT DOCUMENTS

| | | | |
|---|---|---|---|
| 1535608 | 2/1970 | Fed. Rep. of Germany | 139/273 A |

*Primary Examiner*—Henry Jaudon

*Attorney, Agent, or Firm*—Werner W. Kleeman

[57] ABSTRACT

A photoelectrical bobbin feeler, in particular weft bobbin feeler, comprises one light source and two light sensors, or vice versa, two light sources and one light sensor. At least one polaroid filter is arranged in front of the one light source, or one light sensor, respectively, for polarizing the light which is specularly as well as diffusely reflected from the bobbin, and provides for a safer detection of the "bobbin empty" condition.

3 Claims, 4 Drawing Figures

PHOTOELECTRICAL BOBBIN FEELER

BACKGROUND OF THE INVENTION

The present invention refers to a novel and improved photoelectrical bobbin feeler for detecting or discriminating the full and empty conditions of a textile bobbin, which bobbin feeler is provided with three optoelectrical devices. These optoelectrical devices may comprise a light source and first and second light sensors for receiving light emitted from the light source and specularly or diffusely, respectively, reflected from the bobbin, the optoelectrical devices having optical axes defining a scanning plane. The optoelectrical devices may alternatively comprise two alternately pulsed light sources and one light sensor.

There have been known to the art for quite some time weft or filling bobbin feelers for shuttle weaving machines which respond when the bobbin is empty or depleted of yarn winding, in which event the weaving machine is stopped. In order to improve the detection of the "bobbin empty" condition, bobbins have been provided with a reflecting layer, or further have been prepared with a retroreflector, such as "Scotchlite" tape (Minnesota Mining & Manufacturing Comp.).

The use of such bobbins in weaving mills complicates the operation of the looms and increases the costs of production. Thus, recently there has arisen a demand for bobbin feelers which also operate accurately with conventional unprepared weft bobbins. Preferably, such bobbin feelers should also be usable with the known prepared bobbins, such as the ones provided with "Scotchlite" tape.

A photoelectrical bobbin feeler designed for scanning unprepared weft bobbins is described and shown in U.S. Pat. No. 3,693,671. Therein, the optical axes of a D.C.-supplied light source and a first photocell form an obtuse angle, whereas the optical axis of a second photocell is arranged near the optical axis of the light source. The principle of the detection is based on the fact that a normal yarn winding reflects diffusely, whereas the surface of the depleted bobbin shows a distinctly specular reflection. That is the usual weft bobbins are provided with a gloss varnish as a protective layer causing a certain degree of specular reflection. On prolonged use of the weft bobbin, the varnish is worn and the bobbin surface delustered, such that the detection of the "bobbin empty" condition becomes critical or even impossible.

The bobbin feeler known from the aforementioned U.S. Pat. No. 3,693,671 cannot be used for scanning bobbins prepared with "Scotchlite" tape since the second photocell is located near the light source and therefore is energized by light reflected from the retroreflecting tape, and thus, is unable to detect light diffusely reflected from the bobbin which is its very function.

Further, in German Pat. No. 2,335,794 (Swiss patent No. 559,364, Belgian Pat. No. 802,542, U.S. Pat. No. 3,892,492) there is described an optoelectrical weft bobbin feeler which comprises two alternately pulsed directional light sources and a sensor for receiving light emitted by the light sources and reflected from a bobbin. This bobbin feeler affords a distinct improvement in the critical case of dull or mat bobbin cores, and moreover does not respond to ambient light.

In German patent publication No. 1,223,320 there is described a photoelectrical bobbin feeler cooperating with a weft bobbin provided with a specularly reflecting metallic sleeve. This bobbin feeler comprises only one light source and one photosensor each of which is associated with a polaroid screen or filter. This bobbin feeler may generally be used for bobbins having a specularly reflecting or gloss-varnished core, however, does not work with mat or delustered bobbin cores.

Extremely critical is the scanning of bobbins with mat or dull core and glossy yarn winding, such as fiber glass. In this case, the reflection properties of the wrapped and empty bobbin are so close to one another that a difference is difficult to detect. Even in this case detection of the "bobbin empty" condition is possible only if the dull bobbin core exhibits a certain amount of specular reflection, i.e. when the goniometric curve of the reflected light shows a distinct maximum.

SUMMARY OF THE INVENTION

Therefore, it is a primary object of the present invention to provide a novel photoelectrical bobbin feeler which also under the said critical circumstances ensures a safe indication of the "bobbin empty" condition of a bobbin.

A further important object of the invention is the provision of a photoelectrical weft bobbin feeler which may be used with bobbins having a mat or delustered core, as well as bobbins prepared with retroreflecting material, such as "Scotchlite" tape. However, such "Scotchlite" tape should be of the type as generally used for weft bobbins and provided with a glossy protective layer. Anyway, dull "Scotchlite" tape without such a protective varnish is not suitable on bobbin cores.

Now in order to implement the aforementioned objects and others which will become more readily apparent as the description proceeds, the optoelectrical bobbin feeler of this invention, according to a frist embodiment, is generally manifested by the features of a light source, and first and second light sensors for receiving light emitted by the light source and reflected specularly and diffusely, respectively, from the bobbin. The light source and light sensors have optical axes defining a scanning plane. The optical axes of the light source and first light sensor form an obtuse angle $\alpha$. The optical axes of the light source and the second light sensor form an angle $\beta$ of at least 30°. A polaroid screen is arranged in front of the light source such as to pass light components oscillating in a plane perpendicular to the scanning plane.

According to a further embodiment of bobbin feeler for monitoring the winding condition of a textile bobbin, there are provided first and second alternately pulsed light sources, and a light sensor for receiving light emitted by said light sources and reflected specularly and diffusely, respectively, from the bobbin. The light sources and light sensor have optical axes defining a scanning plane. The optical axes of the first light source and the light sensor form an obtuse angle $\alpha$, and a polaroid screen is provided in front of the light sensor such as to pass light components oscillating in a plane perpendicular to the scanning plane.

The embodiments of the inventive photoelectric bobbin feeler which are described in the following context refer, purely by way of example and not limitation, to the scanning of weft bobbins. However, the inventive bobbin feeler may also be adapted to other purposes, such as monitoring of supply spools or cops on yarn winding machines.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENTS

Figure 1:
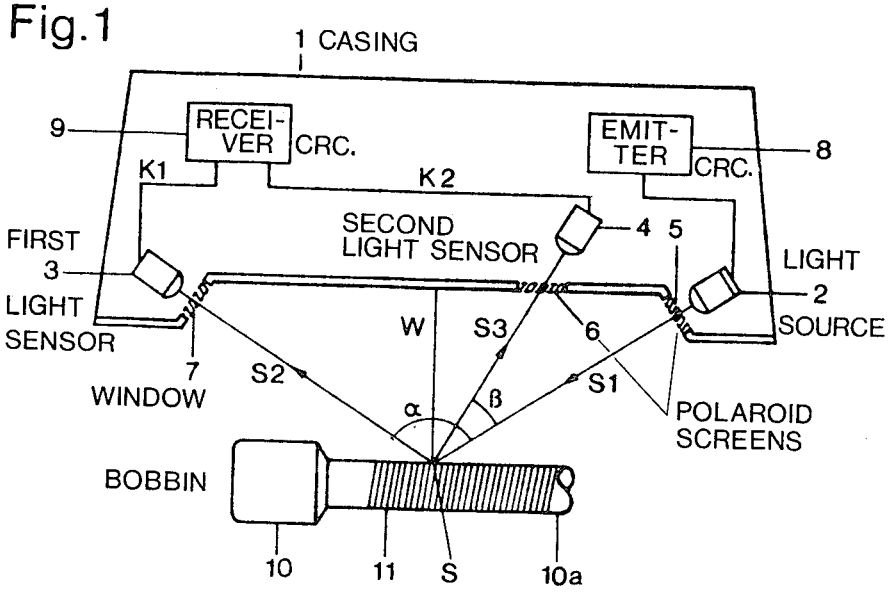
FIG. 1 shows a first embodiment of the inventive bobbin feeler comprising a light source and two light sensors in schematic representation.

With reference to FIG. 1, there is shown a bobbin feeler casing 1 with front wall removed as viewed from the front of the weaving machine or loom (not shown). Casing 1 houses a light source 2, a first light sensor 3, a second light sensor 4, an emitter circuit 8, and a receiver circuit 9. Light source 2 and light sensors 3,4 are preferably of the semiconductor type. A weft or filling bobbin 10 having a core 10*a* bears a yarn winding 11. Light source 2 and light sensors 3,4 have optical axes S1,S2 and S3, which intersect at a point S on the surface of bobbin core 10*a*. The plane defined by the optical axes S1,S2,S3 is conveniently termed herein scanning plane. The optical axes S1 and S2 of light source 2 and first light sensor 3 include an obtuse angle $\alpha$ of e.g. 120°, whose magnitude, however, depends upon the geometric or structural features of the weaving machine or other equipment with which the feeler is used.

The optical axis S1 of the light source 2 and the optical axis S3 of the second light sensor 4 form an acute angle , the magnitude of which is preferably greater than 30°, in order to avoid—in case a retroreflector, such as a varnished "Scotchlite" tape, is attached to core 10*a* of bobbin 10—that light reflected from the retroreflector will impinge upon the second light sensor 4. Polaroid filters or screens 5 and 6 are provided in front of light source 2 and second light sensor 4, respectively. These polaroid screens 5 and 6 are oriented such that the components of light (i.e. the vectors of the electrical field-strength) oscillating in a plane perpendicular to the scanning plane S1,S2,S3 are allowed to pass the polaroid filters. A normal or glass window 7 is provided in front of the first light sensor 3; however, at this place another polaroid filter of analogous orientation may be provided instead. Electrical connections from the first and second light sensors 3 and 4 to a receiver circuit 9 are designated by K1 and K2, respectively.

In FIG. 1, the bisector W of angle $\alpha$ is shown and will be discussed in the following description of FIG. 2, where identical or similar components are conveniently identified with the same reference characters as used in FIG. 1.

Figure 2:
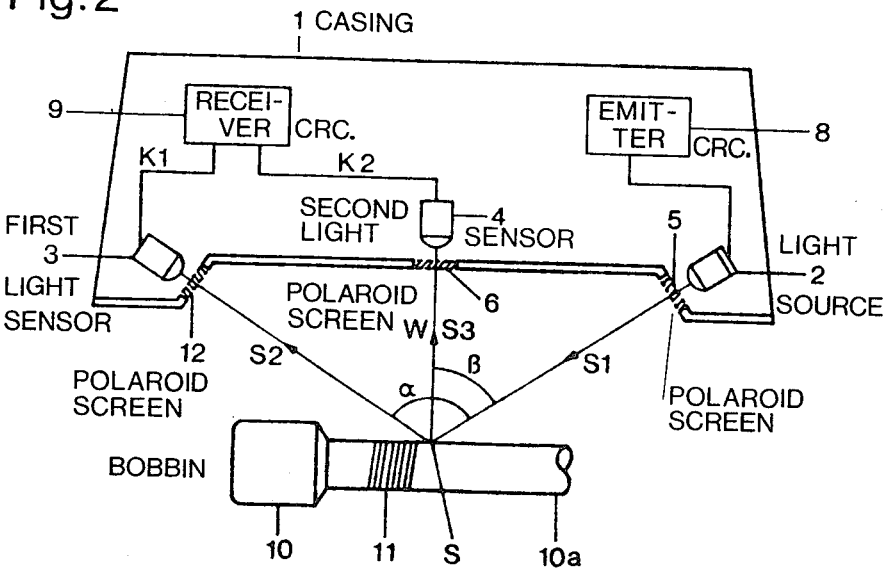
FIG. 2 shows a second embodiment, the angular relations being varied relative to FIG. 1.

In FIG. 2, the second light sensor 4 is arranged in casing 1 at a place other that shown with the embodiment represented by FIG. 1, insofar as the optical axis S3 coincides with angle bisector W. Moreover, in place of window 7, FIG. 1, here a polaroid screen 12 is provided in front of first light sensor 3. The upper limit of the range in which angle $\beta$ may vary is not strictly defined or limited. However, angle $\beta$ preferably is not greater than half the obtuse angle $\alpha$. With $\beta=\alpha/2$ as shown in FIG. 2, the second light sensor 4 is placed symmetrically in the middle plane between light source 2 and first light sensor 3, and the optical axis S3 of second light sensor 4 coincides with angle besector W. Any further increase of angle $\beta$ brings no essential improvement.

Figure 3:
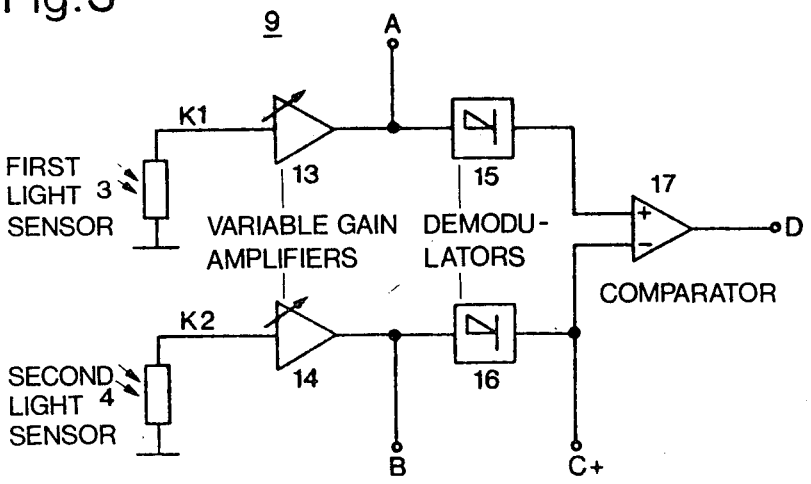
FIG. 3 is a block diagram of the receiver circuit shown in FIGS. 1 and 2.

FIG. 3 shows the arrangement of receiver circuit 9 in block schematic. Light source 2, FIGS. 1 and 2, is assumed to emit pulsed light as known per se. The pulse repetition rate may be e.g. 10 Kilocycles.

The first channel K1 connected to first light sensor 3 comprises a series connection of a controllable or variable gain amplifier 13 and a demodulator 15. The second channel K2 connected to second light sensor 4 also comprises a variable gain amplifier 14 and a demodulator 16. The demodulators 15 and 16 comprise rectifying and smoothing circuits as is well known from the art, so as to eliminate the high frequency pulses.

The outputs of the demodulators 15,16 are connected to the positive and negative inputs, respectively, of a comparator 17. The negative input of comparator 17 is biased at terminal C+ by a small positive D.C. voltage of e.g. 0.3 Volt, so that comparator 17 responds only to distinctly positive voltages at the positive input thereof. The terminals A and B serve for testing and balancing purposes, enabling receiver circuit 9 to be tested and balanced as will still be explained with reference to the following test.

With this test the effect of one polaroid screen, or two such screens on the bobbin feeler shown in FIG. 1 was examined, particularly in the problematic case—dull or mat bobbin core and glass fiber winding. The results are listed in the following table under II. Prior to each measurement the bobbin feeler with the arrangement without or with filter as noted under II., however with wrapped bobbin, was adjusted, by means of the variable gain amplifiers 13,14, such that the output voltages thereof at terminals A and B were set to the same value of 4 Volts as stated under I. Thereafter, with unchanged setting of variable gain amplifiers 13,14, the actual measurement with the empty bobbin was made as stated under II.

TABLE

| | Channel K1 Terminal A | Channel K2 Terminal B | Voltage Difference |
|---|---|---|---|
| I. Balance with wrapped bobbin | 4 V | 4 V | 0 V |
| II. Measurements with empty bobbin | | | |
| (1) without polaroid screen | 2.85 V | 2.25 V | 0.6 V |
| (2) polaroid screen at source 2 | 4.25 V | 2.00 V | 2.25 V |
| (3) polaroid screens at source 2 and sensor 4 | 4.25 V | 1.50 V | 2.75 V |

From the above description to FIG. 3 it follows that the condition "bobbin empty" is detected when the voltage difference between terminals A and B is greater than 0.3 Volts, that is the bias at terminal C+.

The measurement II(1) without polaroid filter shows only a low signal difference of 0.6 Volts, which is great enough to cause comparator 17 to respond. The measurement II(2) with one polaroid screen in front of light source 2 results in a difference of 2.25 Volts, and the measurement II(3) with two polaroid screens furnishes a still greater difference of 2.75 Volts. A comparison of the measurements II(2) and II(3) with filter, on the one hand, and measurement II(1) without filter, on the other hand, shows that the difference signal is increased by a factor of about 4 when using polaroid filter means. Thus, the safety of the detection of the condition "bobbin empty" is correspondingly increased.

Figure 4:
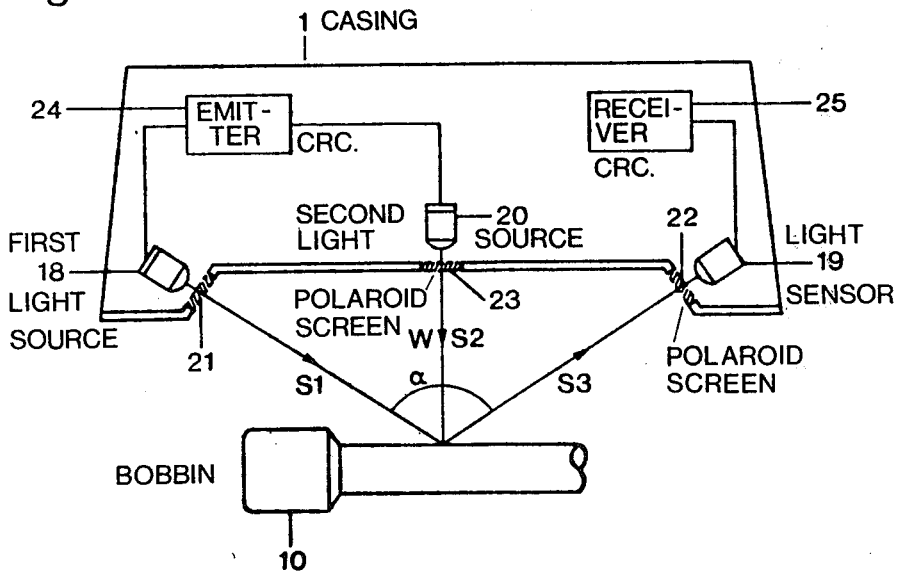
FIG. 4 shows a further embodiment of the inventive bobbin feeler comprising two light sources and a light sensor.

A modified embodiment of the inventive bobbin feeler, as shown in FIG. 4, operates with first and second light sources 18,20 and one light sensor 19. Individual polaroid screens 22,23 are provided in front of light sensor 19 and second light source 20, respectively. The arrangement is symmetrical as in the embodiment shown in FIG. 2, the optical axis S2 of second light source 20 coinciding with the angle bisector W of obtuse angle $\alpha$ formed by the optical axis S1 of first light source 18 and the optical axis S3 of light sensor 19.

Electronic circuitry for operating emitter circuit 24 and receiver circuit 25 is known e.g. from the above mentioned German patent No. 2,335,794 and the corresponding patents in other countries.

With a single light source as shown in FIG. 1, the use of a single polaroid screen causes an essential improvement, as may be seen from measurement II(2) in the above table. In this embodiment, the single polaroid screen must be arranged in front of the single light source in order to polarize, in a direction perpendicular to the scanning plane S1,S2,S3, light specularly reflected along optical axis S2 as well as diffusely reflected along optical axis S3. As shown by the measurement II(3) in the table, the provision of a second polaroid screen in front of the second light sensor still yields a noticeable improvement.

With the embodiment shown in FIG. 4, the light emanating from the light sources 18 and 20 need not be polarized: all the light influencing the measurement is filtered out by the single light sensor 19 and polarized in a direction perpendicular to the scanning plane S1,S2,S3.

In any case, increased safety of the detection of the "bobbin empty" condition may be achieved with only one polaroid screen. With only one light source, FIGS. 1 and 2, the polaroid screen is to be arranged in front of this light source, however, with only one light sensor, FIG. 4, in front of this light sensor. In other words: the best effect is attained when all the light used for and influencing the measurement is polarized.

With the embodiments according to FIGS. 1 and 2, the light source 2 may be energized by D.C. as well as A.C. current as known per se. However, pulsed light is preferable in order to eliminate the influence of ambient light. In the embodiment shown in FIG. 4, the light sources 18 and 20 should at any rate be alternately pulsed, since otherwise it is impossible to separate and compare the signals, in the receiver circuit, stemming from the two light sources.

The above-described bobbin feelers may generally be used with textile spools or bobbins of any kind, such as bobbins prepared with specularly reflecting or retroreflecting means. However, said bobbin feelers yield exceptional advantage with unprepared, in particular delustered bobbins provided with glossy winding, such as glossy or glass fiber yarn.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A photoelectrical bobbin feeler for monitoring the winding condition of a textile bobbin, comprising a light source, first and second light sensors for receiving light emitted by the light source and reflected specularly and diffusely, respectively, from the bobbin, wherein the light source and light sensors have optical axes defining a scanning plane, the optical axes of the light source and first light sensor form an obtuse angle $\alpha$, the optical axes of the light source and the second light sensor form an angle $\beta$ of at least 30°, and a polaroid screen is arranged in front of the light source such as to pass light components oscillating in a plane perpendicular to the scanning plane.

2. The bobbin feeler as claimed in claim 1, wherein the angle $\beta$ is an acute angle not greater than half the obtuse angle $\alpha$.

3. A photoelectrical bobbin feeler for monitoring the winding condition of a textile bobbin, comprising first and second alternately pulsed light sources, a light sensor for receiving light emitted by said light sources and reflected specularly and diffusely, respectively, from the bobbin, wherein said light sources and light sensor have optical axes defining a scanning plane, the optical axes of the first light source and the light sensor form an obtuse angle $\alpha$, and a polaroid screen is provided in front of the light sensor such as to pass light components oscillating in a plane perpendicular to the scanning plane.

* * * * *